US008210887B2

(12) United States Patent
Dixon

(10) Patent No.: US 8,210,887 B2
(45) Date of Patent: Jul. 3, 2012

(54) BASE ASSEMBLY USEFUL IN PERMITTING A FLOATING CAMPFIRE

(75) Inventor: Ronald George Dixon, Strathroy (CA)

(73) Assignee: Ronald George Dixon, Strathroy, ON (CA)

( * ) Notice: Subject to any disclaimer, the term of this patent is extended or adjusted under 35 U.S.C. 154(b) by 246 days.

(21) Appl. No.: 12/570,070

(22) Filed: Sep. 30, 2009

(65) Prior Publication Data

US 2011/0073031 A1 Mar. 31, 2011

(51) Int. Cl.
*B63B 45/00* (2006.01)
*B63B 22/00* (2006.01)
*B63B 51/02* (2006.01)

(52) U.S. Cl. ..... 441/13; 441/19

(58) Field of Classification Search ..... 114/364, 114/264; 362/477, 190; 472/128, 129; 441/13, 441/19

See application file for complete search history.

(56) References Cited

U.S. PATENT DOCUMENTS

| | | | | | |
|---|---|---|---|---|---|
| 3,032,783 | A * | 5/1962 | Swanson, Jr. | 114/364 |
| 3,614,417 | A * | 10/1971 | Sanford | 441/14 |
| 3,707,736 | A * | 1/1973 | Bass | 441/13 |
| 5,251,113 | A * | 10/1993 | Wagoner et al. | 362/190 |
| 5,363,977 | A * | 11/1994 | Hoff | 220/4.27 |
| 5,411,011 | A * | 5/1995 | Teta | 126/50 |
| 5,619,944 | A * | 4/1997 | Baker | 114/61.1 |
| 7,404,371 | B2 * | 7/2008 | Schmitt | 114/346 |
| 2004/0168683 | A1 * | 9/2004 | Knight | 126/30 |

FOREIGN PATENT DOCUMENTS

JP 2004049049 A * 2/2004

* cited by examiner

*Primary Examiner* — Lars A Olson
*Assistant Examiner* — Anthony Wiest
(74) *Attorney, Agent, or Firm* — Marks & Clerk

(57) ABSTRACT

Disclosed is a base assembly useful in permitting a floating campfire, comprising a base shaped to float in open water, the base having an airtight pontoon portion at its periphery; and a floor defining an opening therethrough to accommodate a fire bowl to house the campfire; wherein the base assembly is constructed to counteract the weight of the campfire in use such that the base assembly floats in open water. The base assembly is preferably square in shape. The floor is preferably made of aluminum checker plate and TIG welded in a stitch pattern to the centre.

10 Claims, 7 Drawing Sheets

BASE ASSEMBLY USEFUL IN PERMITTING A FLOATING CAMPFIRE

FIELD OF THE INVENTION

The present invention relates to the field of outdoor recreation. More specifically, the present invention relates to a base assembly useful in permitting a floating campfire.

BACKGROUND OF THE INVENTION

There are readily available a number of different types of systems to provide campfires for recreation and cooking purposes. However, all known systems are limited to use on land.

SUMMARY OF THE INVENTION

Disclosed is a base assembly useful in permitting a floating campfire. The campfire can then be used for either recreation and/or cooking purposes.

Thus, according to one aspect, the invention provides a base assembly useful in permitting a floating campfire, comprising a base shaped to float in open water, the base having: an airtight pontoon portion at its periphery; and a floor defining an opening therethrough to accommodate a fire bowl to house the campfire; wherein the base assembly is constructed to counteract the weight of the campfire in use such that the base assembly floats in open water.

There are many advantages in using a base assembly in accordance with the teachings of this invention. The instant base assembly floats on the surface of the water, allowing the user to set up a campfire in any open water area.

Other aspects and advantages of embodiments of the invention will be readily apparent to those ordinarily skilled in the art upon a review of the following description.

BRIEF DESCRIPTION OF THE DRAWINGS

Embodiments of the invention will now be described in conjunction with the accompanying drawings, wherein.

This invention will now be described in detail with respect to certain specific representative embodiments thereof, the materials, apparatus and process steps being understood as examples that are intended to be illustrative only. In particular, the invention is not intended to be limited to the methods, materials, conditions, process parameters, apparatus and the like specifically recited herein.

DETAILED DESCRIPTION OF THE DISCLOSED EMBODIMENTS

Figure 1:
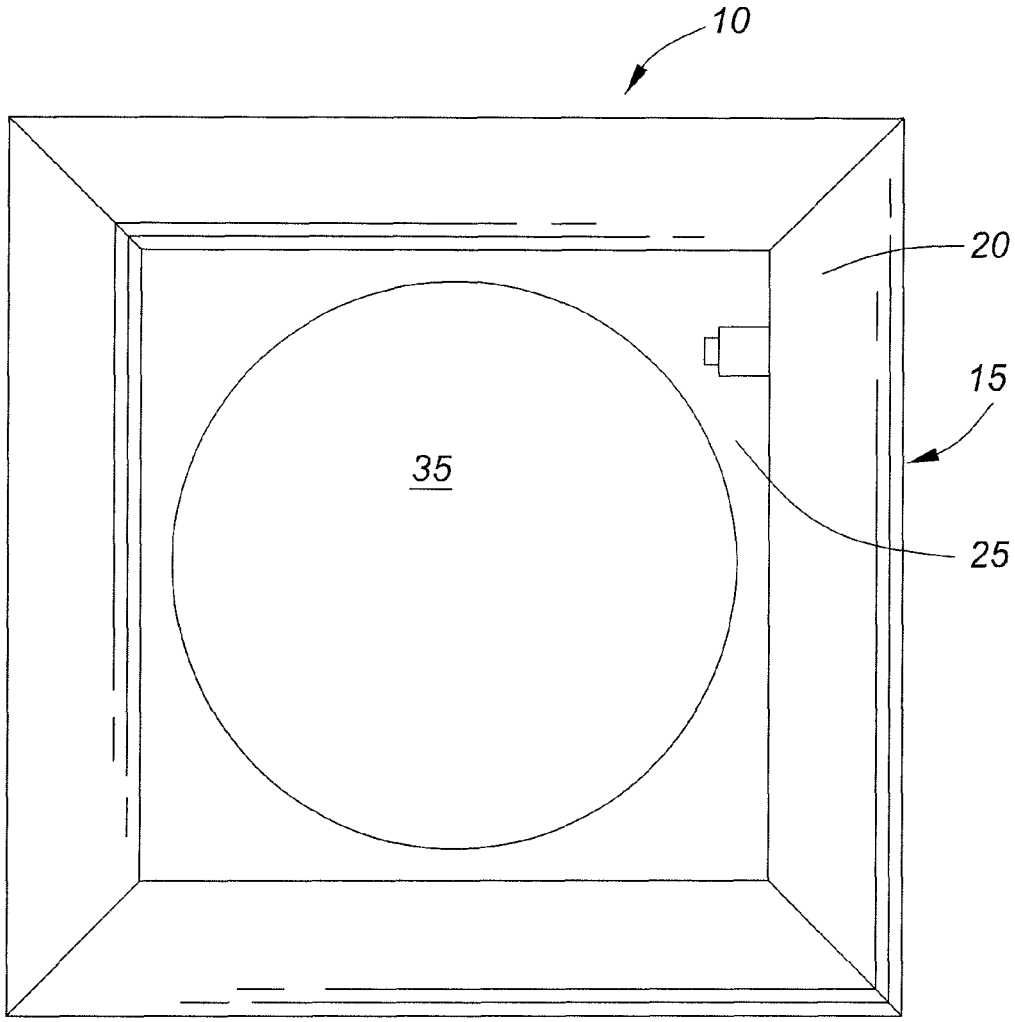
FIG. 1 illustrates a bottom view of the base in accordance with the teachings of this invention.
Figure 2:
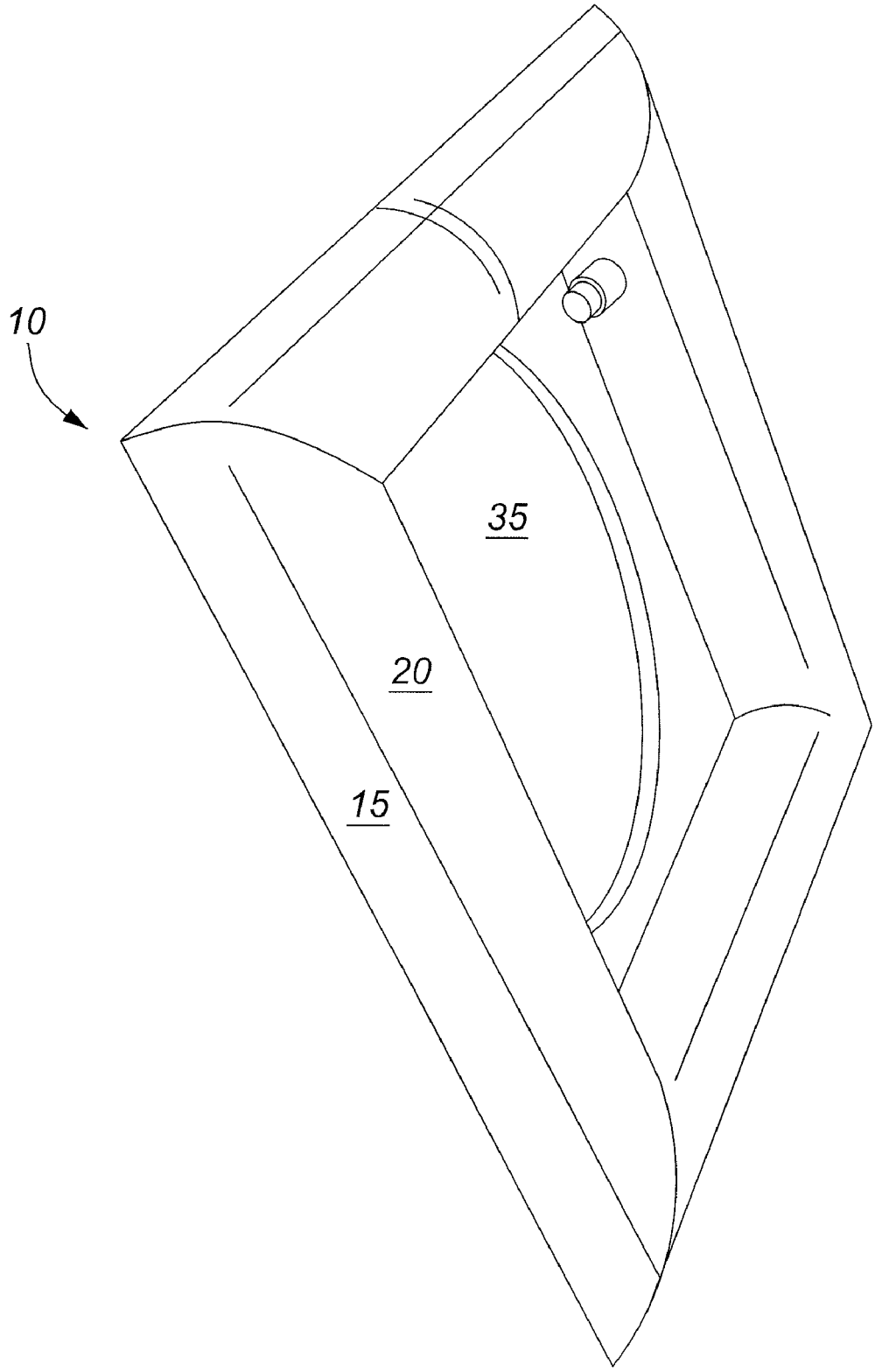
FIG. 2 is a bottom perspective view of the base of FIG. 1.

Referring to FIGS. 1 and 2, there is shown a bottom view and a bottom perspective view, respectively of a portable floating base 10 for a campfire according to a preferred embodiment.

The base 10 in accordance with the teachings of this invention support a fire bowl as is discussed in detail below. The fire bowl and base can then be used to provide a campfire in the water. The campfire could be used for both recreational and/or cooking purposes.

Again referring to FIGS. 1 and 2, a preferred configuration of the base 10 is now described. The base 10 is illustrated to be square-shaped, comprising a pontoon portion 20 at its periphery 15. The pontoon portion is an airtight tube sized and shaped to counteract the weight of the campfire in use, thus permitting the base assembly to float.

The pontoon portion leads to floor 25. Floor 25 has therein a circular opening 35 which is sized and shaped to accommodate the fire bowl as described below.

Figure 3:
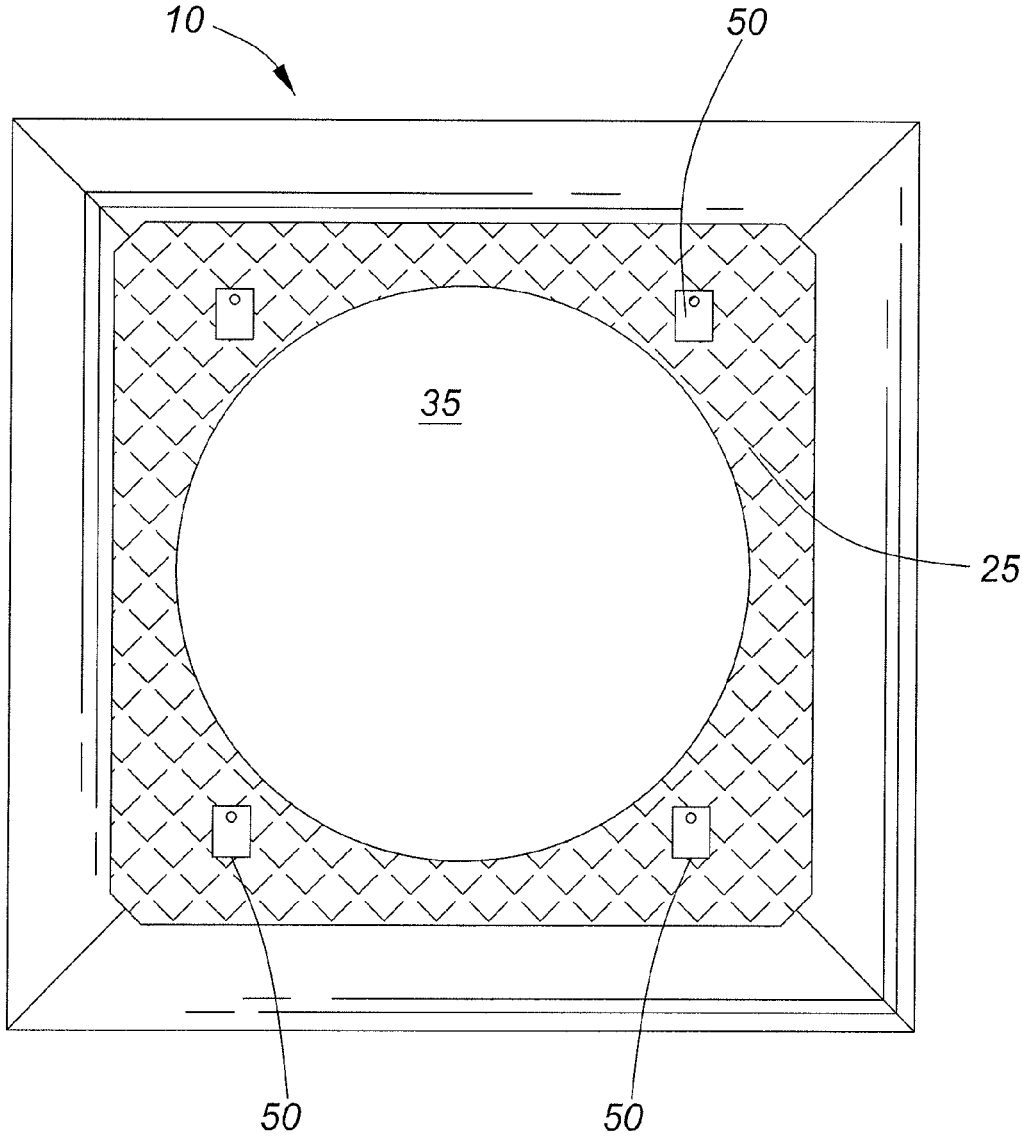
FIG. 3 is a top view of the base of FIG. 1.
Figure 4:
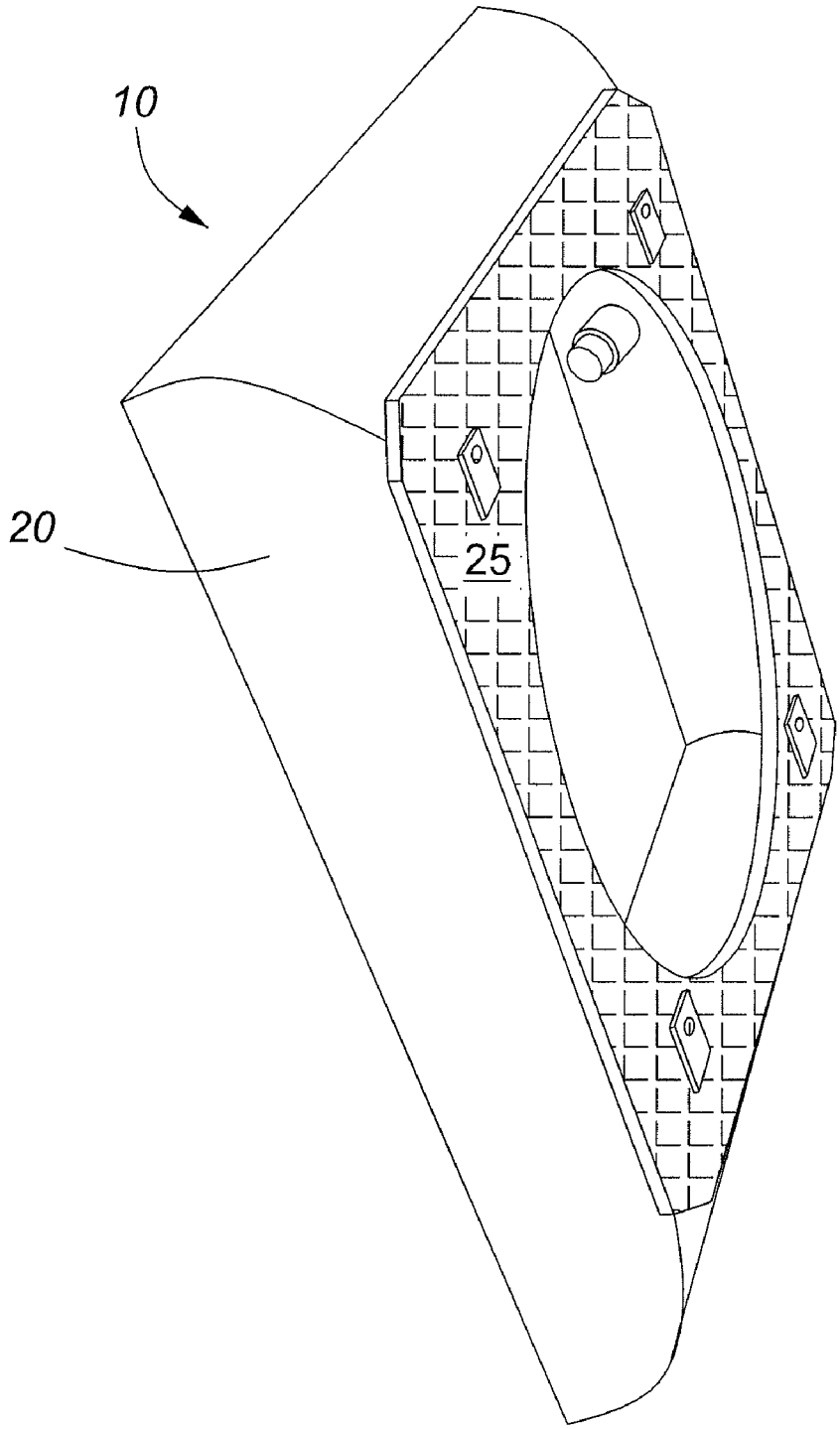
FIG. 4 is a top perspective view of the base of FIG. 1.

FIGS. 3 and 4 are a top view and top perspective view, respectively of the base 10 of FIGS. 1 and 2 showing the top surface of floor 25. The floor could be any fire-resistant material that can be securely attached to the pontoon. Clips 50 are used to hold the fire bowl in place during use.

Figure 6:
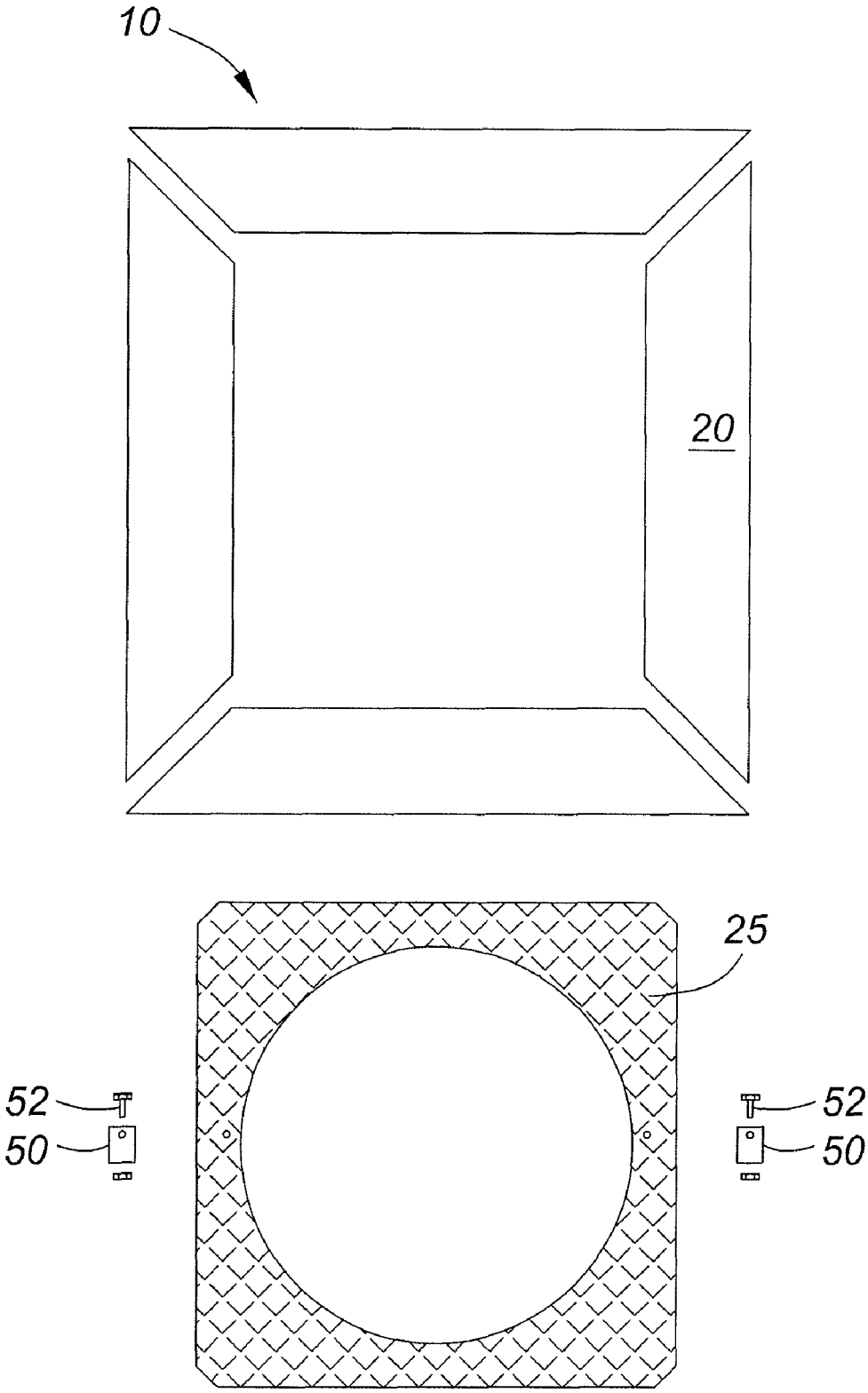
FIG. 6 illustrates an exploded view of the base assembly of FIGS. 4 and 5 and its relationship with respect to a fire bowl in accordance with the teachings of this invention.
Figure 7:
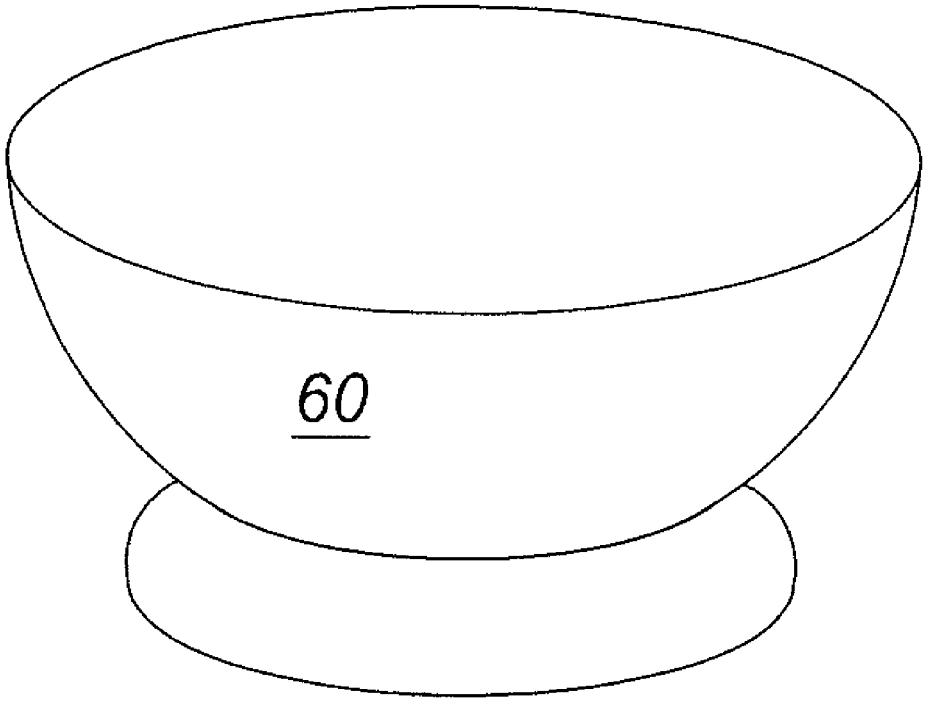
FIG. 7 illustrates one commercially-available fire bowl that is recommended for use with embodiments of this invention.

FIG. 6 provides an exploded view of the base 10. In accordance with the teachings of this invention, base 10 is sized and shaped to accommodate any suitable fire bowl available. As seen in FIG. 7, fire bowl 60 comprises a main cylindrical body 65 with inner surface 70 with upper flanged lip 75 extending radially outward from the upper end 80 of inner surface 70. The fire bowl 60 is dimensioned to fully extend through opening 35 in floor 25, and suspend from the bottom of the base 10 such that floor 25 captures upper flanged lip 75.

Preferably, the fire bowl 60 is of a diameter less than opening 35 the fire bowl 60 can be easily inserted downward through the opening 35 until upper flanged lip 75 comes in supporting contact with floor 25.

Figure 5:
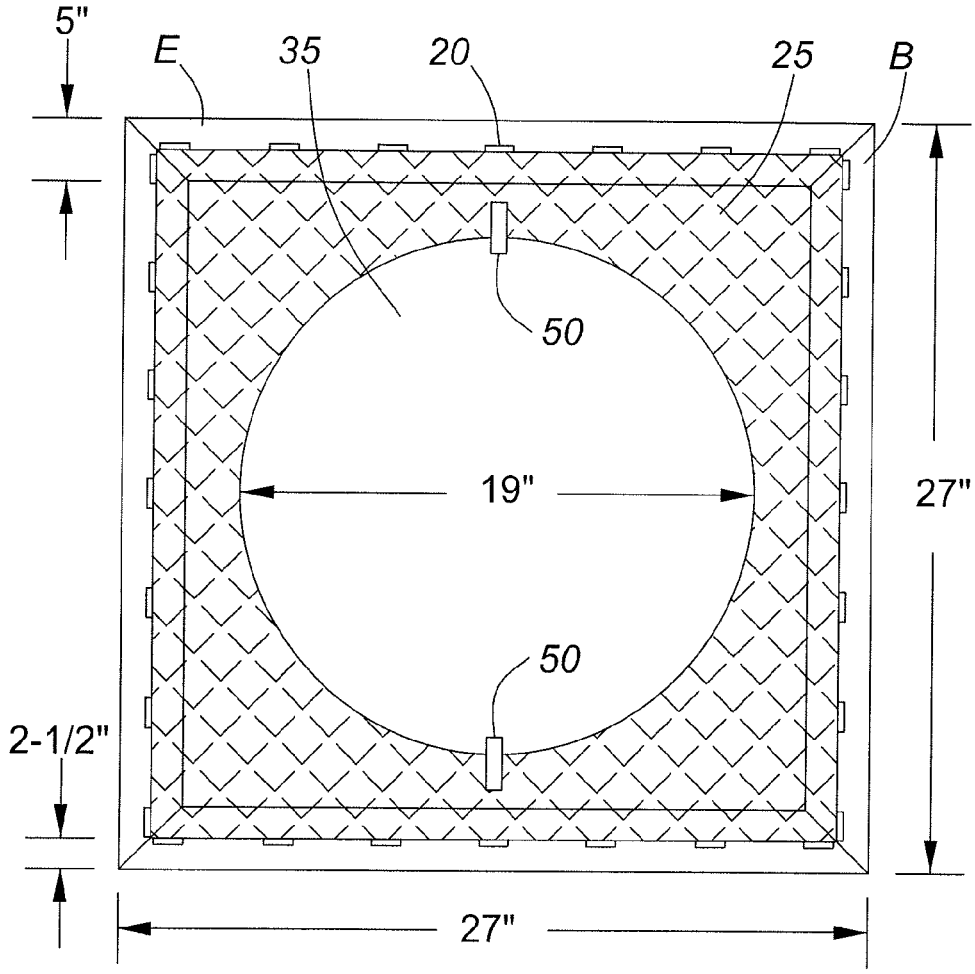
FIG. 5 illustrates the base of FIG. 3 with some exemplary dimensions.

FIG. 5 illustrates some preferred dimensions for the base 10, but it is to be understood that these are just exemplary. The pontoon portion 20 is comprised of four pieces of ⅛" thick aluminum tubing, 5" in diameter, 27" long on the outside perimeter and 17" long on the inside perimeter, cut at a 45-degree angle at each end. These four pieces are TIG welded together to form a square. The floor 25 is a 22" by 22" square piece of ⅛" thick aluminum checker plate with a circle 19" in diameter cut out of the centre and TIG welded in a stitch pattern to the centre of the pontoon portion 20. The clips 50 are bolted on opposite sides of the cutout circle 35 by pins 52 and hold the fire bowl in place. The clips 50 pivot to allow easy installation and removal of the fire bowl 60. The base assembly is constructed to counteract the weight of the campfire in use such that the base assembly floats in open water.

Any symmetrical shape with at least three sides (triangle, square, pentagon, etc.) could be used a base in accordance with the teachings of this invention.

A recommended fire bowl 60 for the floating base in accordance with the teachings of this invention is the DeckMate Outdoor Embossed Acanthus Fire Bowl produced by Kay Home Products (Item 30042CDI), but any fire bowl of similar dimensions could be used.

In accordance with the teachings of this invention, the base 10 with a fire bowl floats on the surface of the water, allowing the user to set up a campfire in any open water area.

Numerous modifications may be made without departing from the spirit and scope of the invention as defined in the appended claims.

What is claimed is:

1. A base assembly for supporting a fire bowl providing a floating campfire in use, the fire bowl having an outwardly flanged lip at its periphery, the base assembly comprising a base constructed to float in open water, the base having:

an airtight pontoon portion at its periphery; and a floor in the base assembly defining an opening therethrough to accommodate the fire bowl to house the campfire, the opening being sized to permit the fire howl to extend therethrough and suspend from the floor into the water in use;

wherein the floor catches and supports an outwardly flanged lip when the fire bowl is suspended through the opening;

wherein the base assembly is constructed to counteract the weight of the campfire in use such that the base assembly floats in open water; and wherein the fire bowl and base assembly are made of a fire-resistant material.

2. The base assembly of claim 1, wherein the base assembly is square in shape.

3. The base assembly of claim 1, wherein the floor is made of aluminum checker plate and TIG welded in a stitch pattern to a centre of the floor.

4. The base assembly of claim 1, wherein the opening is circular.

5. The base assembly of claim 1, further comprising clips on the floor used to hold the fire bowl in place during use.

6. A kit for providing a floating campfire in use, the kit comprising:

a fire bowl for housing the campfire in use, the fire bowl having an outwardly flanged lip at its periphery;

a complimentary base assembly the supporting the fire bowl, the base assembly comprising a base constructed to float in open water, the base having:

an airtight pontoon portion at its periphery; and a floor defining an opening therethrough, the opening being constructed and arranged to accommodate the fire bowl, the opening being sized to permit the fire bowl to extend therethrough and suspend from the floor into the water in use;

wherein the floor catches and supports the flanged lip when the fire bowl is suspended through the opening;

wherein the base assembly is constructed to counteract the weight of the campfire in use such that the base assembly floats in open water; and wherein the fire bowl and base assembly are made of a fire-resistant material.

7. The kit of claim 6, wherein the base assembly is square in shape.

8. The kit of claim 6, wherein the floor is made of aluminum checker plate and TIG welded in a stitch pattern to a centre of the floor.

9. The kit of claim 6, wherein the opening is circular.

10. The kit of claim 6, further comprising clips on the floor used to hold the fire bowl in place during use.

* * * * *